United States Patent [19]

Turnbull

[11] Patent Number: 4,881,298

[45] Date of Patent: Nov. 21, 1989

[54] SEPARABLE DOOR HINGE FOR VEHICLE BODY

[75] Inventor: Roy C. Turnbull, Troy, Mich.

[73] Assignee: General Motors Corporation, Detroit, Mich.

[21] Appl. No.: 223,127

[22] Filed: Jul. 21, 1988

[51] Int. Cl.[4] ..... E05D 7/10

[52] U.S. Cl. ..... 16/266; 16/380; 49/463; 296/147; 296/202

[58] Field of Search ..... 16/254, 260, 265, 266, 16/366, 380, 386, 387, 388; 49/381, 463; 296/147, 202

[56] References Cited

U.S. PATENT DOCUMENTS

| | | | |
|---|---|---|---|
| 2,677,147 | 5/1954 | Phillips | 16/266 |
| 4,070,056 | 1/1978 | Hickman | 296/148 |
| 4,765,025 | 8/1988 | Salazar | 16/266 |
| 4,766,643 | 8/1988 | Salazar | 16/266 |
| 4,807,331 | 2/1989 | Calucci | 16/262 |

FOREIGN PATENT DOCUMENTS

| | | | |
|---|---|---|---|
| 274552 | 7/1988 | European Pat. Off. | 16/260 |
| 2502676 | 10/1982 | France | 16/260 |

*Primary Examiner*—Nicholas P. Godici
*Assistant Examiner*—William Scott Andes
*Attorney, Agent, or Firm*—Charles E. Leahy

[57] ABSTRACT

First and second hinge leaves are mounted respectively on the body and the door with one hinge leaf having a pivot pin and the other hinge having a hinge aperture adapted to engage the pivot pin to establish a door hinge pivot axis. The first and second leaves have flanges which interengage one another through the normal range of pivoting movement of the door between open and closed position so as to maintain the engagement between the hinge aperture and the pivot pin. The door is separable from the body by pivoting the door beyond the range of normal pivoting movement to disengage the bearing portions of the hinge leaves from one another and then lifting the door axially of the hinge pin axis to disengage the hinge aperture and the pivot pin. The separable door hinge also includes an offset auxiliary pivot axis provided by an alignment abutment on one of the hinge leaves axis and an alignment notch provided on the other of the hinge leaves. The alignment abutment and the alignment notch come into engagement with one another during attempted rehanging of the door and enable swinging movement of the door to carry the pivot pin and the pivot aperture in axial alignment with one another so that the door mounted hinge leaf may be lowered onto the body mounted hinge leaf.

6 Claims, 2 Drawing Sheets

SEPARABLE DOOR HINGE FOR VEHICLE BODY

The invention relates to a vehicle door, and more particularly, separable door hinges which enable the vehicle door to be lifted off the body during car assembly or aftermarket service, and then easily rehung on the body.

BACKGROUND OF THE INVENTION

It is known in the prior art to provide vehicle door hinges mounting a vehicle door on a vehicle body. Typically, such hinges are comprised of a body mounted hinge leaf and a door mounted hinge leaf. Furthermore, two of such hinges are commonly employed, an upper hinge and a lower hinge, in order to provide a stable door mounting.

The present invention provides a new and improved door hinge assembly which enables the door to be easily removed from the vehicle body and then subsequently rehung on the vehicle body.

In the vehicle assembly plant it is desirable to mount the doors on the vehicle body for painting of the body, and to then remove the door from the body for assembly processing. In this way the door may be routed through the assembly plant separate from the vehicle body for the installation of the door hardware such as window regulators, door latches, etc. Furthermore, removal of the door from the vehicle body facilitates the installation of the seats, instrument panel, steering column, and other assemblies into the vehicle body. Later in the assembly process, the door is rehung on the body.

The separable hinge also permits the door to be removed from the body in order to facilitate aftermarket repairs of the vehicle. For example, the entire door may be removed from the vehicle and placed upon a work bench for convenient repairs of the door components or repair of any dents in the sheet metal.

SUMMARY OF THE INVENTION

According to the invention, first and second hinge leaves are mounted respectively on the body and the door with one hinge leaf having a pivot pin and the other hinge leaf having a hinge aperture adapted to engage the pivot pin to establish a door hinge pivot axis. The first and second leaves have portions which bear on one another through the normal range of pivoting movement of the door between open and closed positions so as to maintain the engagement between the hinge aperture and the pivot pin. The door is separable from the body by pivoting the door beyond the range of normal pivoting movement to disengage the bearing portions of the hinge leaves from one another and then lifting the door axially of the hinge pin axis to disengage the hinge aperture and the pivot pin. The separable door hinge also includes an alignment abutment provided on one of the hinge leaves and extending parallel to the pivot axis and an alignment notch provided on the other of the hinge leaves. The alignment abutment and the alignment notch come into engagement with one another during attempted rehanging of the door and serve to establish the pivot pin and the pivot aperture in axial alignment with one another so that the door mounted hinge leaf may be lowered on to the body mounted hinge leaf, thereby effecting the reengagement between the pivot pin and the hinge aperture to subsequently enable pivoting movement of the door to within the normal range of pivoting movement.

DESCRIPTION OF THE DRAWINGS

These and other objects, features and advantages of the invention will become apparent upon consideration of the description of the preferred embodiment and the appended drawings in which.

DESCRIPTION OF THE PREFERRED EMBODIMENT

Figure 4:
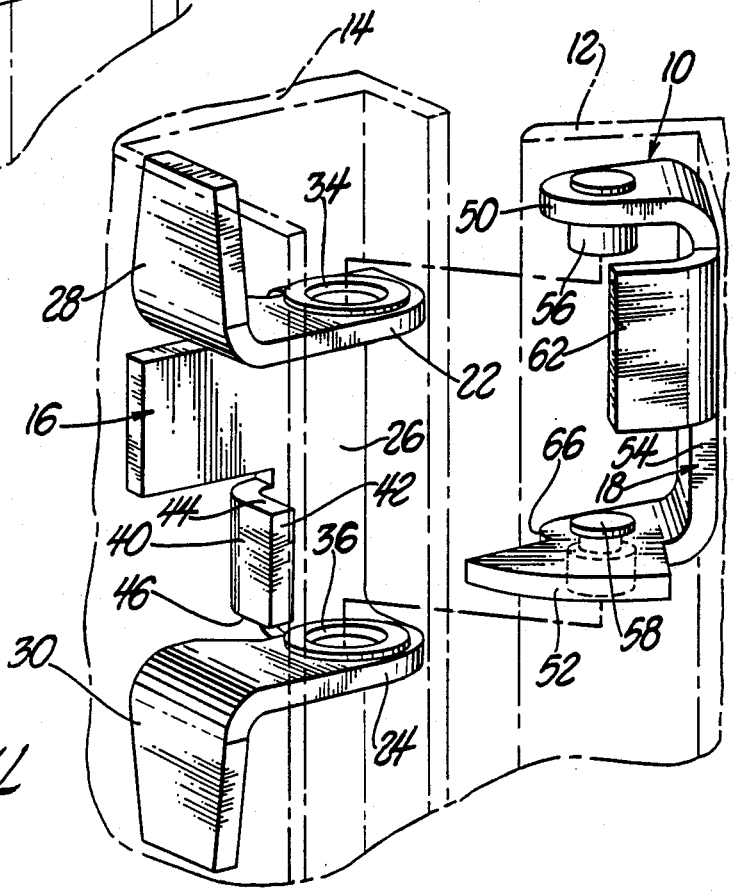
FIG. 4 shows the hinge separated and the door removed from the vehicle body.

Referring to the drawings, it is seen that a separable door hinge 10 is provided for mounting a vehicle door 12 upon a vehicle body 14. As best seen in FIG. 4, the separable hinge 10 includes a body mounted hinge leaf 16 and a door mounted hinge leaf 18 which are preferably constructed by stamping from heavy gauge sheet metal material.

The body mounted hinge leaf 16, best shown in FIG. 4, includes an upper flange 22 and a lower flange 24 which are integrally connected by a web 26. The upper flange 22 has a mounting tab 28 which is bent upwardly and is suitably attached to the vehicle body 14 by bolting or welding or other suitable attaching means. Likewise, the lower flange 24 has a downwardly bent mounting tab 30 which is attached to the vehicle body 14. If desired, additional attachments may be provided between the web 26 and the vehicle body 14. The flanges 22 and 24 extend horizontally with respect to the vehicle body and have aligned apertures defined by cylindrical bushings 34 and 36 which are preferably metallic and are press fit into the apertures of the flanges 22 and 24. The bushings 34 and 36 are axially aligned with one another in the vertical direction. The hinge leaf 16 also includes a flange 40 which is bent from the web 26 and overlies the lower flange 24 in spaced relation therefrom. The flange 40 has an alignment surface 42 which extends generally vertically and parallel with the pivot axis of the bushings 34 and 36. In addition, the flange 40 has an upper surface 44 and a lower surface 46 which will be discussed further hereinafter.

The hinge leaf 18 includes an upper flange 50 and a lower flange 52 which are integrally connected by a vertical web 54. The web 54 is suitably attached to the vehicle door by bolts, or welding, or other suitable attaching means. The upper flange 50 and lower flange 52 extend horizontally with respect to the vehicle body and respectively carry pivot pins 56 and 58 which extend downwardly from the undersurfaces of the flanges 50 and 52. The pivot pins 56 and 58 are axially aligned with one another and the vertical spacing between the flanges 50 and 52 is the same as the vertical spacing between the flanges 22 and 24 of the body mounted hinge leaf 16. The hinge leaf 18 also has a flange 62 which is bent from the web 54 and underlies the upper flange 50. The lower flange 52 is configured to provide an alignment notch 66 facing toward the body mounted hinge 16.

FIG. 4 shows the door 12 separated from the vehicle body 14. In order to mount the door 12 on the body 14, the vehicle assembler or service person carries the door 12 toward the vehicle body 14 with the door 12 lifted somewhat above its mounted position so that the alignment notch 66 of the door mounted hinge leaf 18 is carried into engagement with the vertical alignment surface 42 of the body mounted hinge leaf 16 as shown in FIG. 3. It will be appreciated that FIG. 4 shows only one of the door hinges, it being understood that most door installations will have both an upper hinge and a lower hinge. The engagement of the alignment notch 66 with the alignment surface 42 establishes the pivot pins 56 and 58 of the hinge leaf 18 in nearly aligned position with respect to the bushings 34 and 36 of the hinge leaf 16. By pushing the door in the direction to maintain the notch 66 in engagement with the alignment surface 42, and then lowering the door somewhat so that the pivot pins 56 and 58 come to rest upon the bushings 34 and 36, the operator is able to rest the door on the hinges. Then the door is bodily pivoted somewhat inwardly or outwardly about the auxiliary pivot point defined by the engagement between the alignment surface 42 and the alignment notch 66 so that the pivot pins 56 and 58 swing in an arc intersecting the pivot aperture provided by bushings 36 and 38 until the pivot pins 56 and 58 are properly aligned with the bushings 34 and 36. The bushings 34 and 36 are preferably chamfered to facilitate the entry of the pivot pins 56 and 58. When the angular alignment of the door aligns the pivot pins 56 and 58 with the bushings 34 and 36, the weight of the door will cause the pins to drop and engage in the apertures, as shown in FIG. 2.

Figure 1:
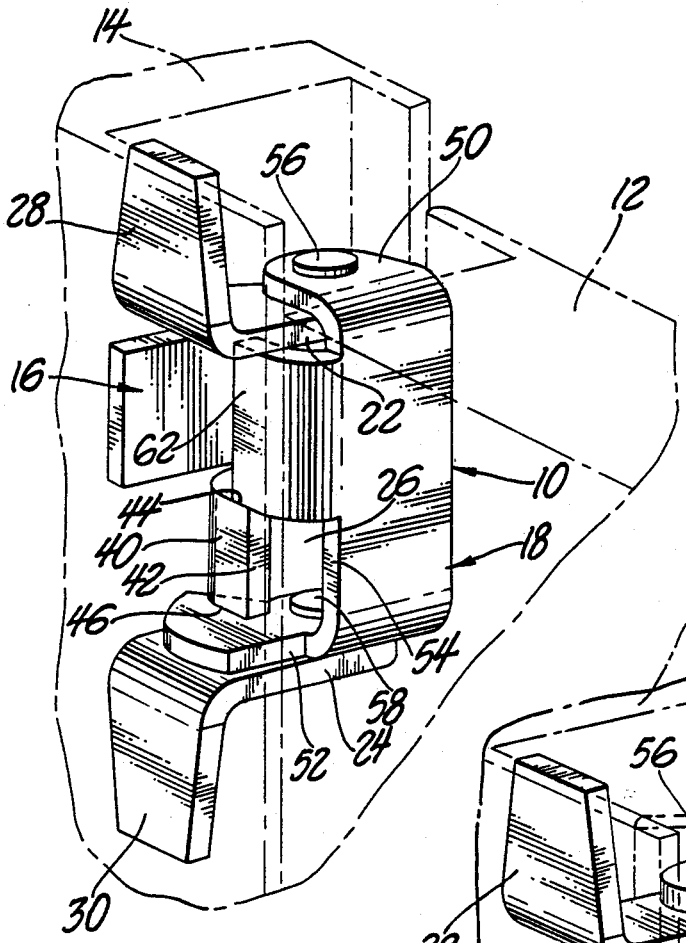
FIG. 1 is a perspective view of the separable door hinge showing the door hung upon the vehicle body and the door pivoted to the closed position.
Figure 2:
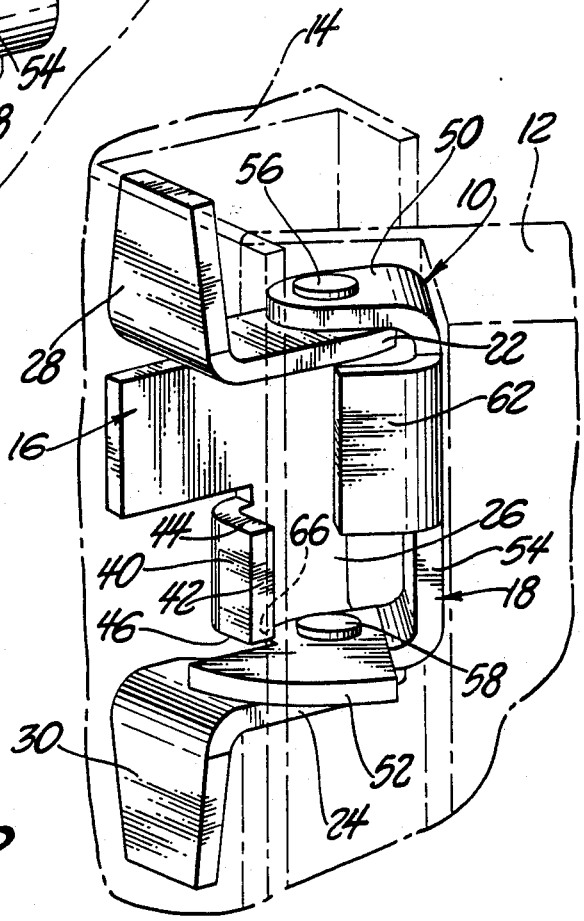
FIG. 2 is similar to FIG. 1 but showing the door pivoted open somewhat beyond the range of normal opening movement to enable removal of the door from the body.
Figure 3:
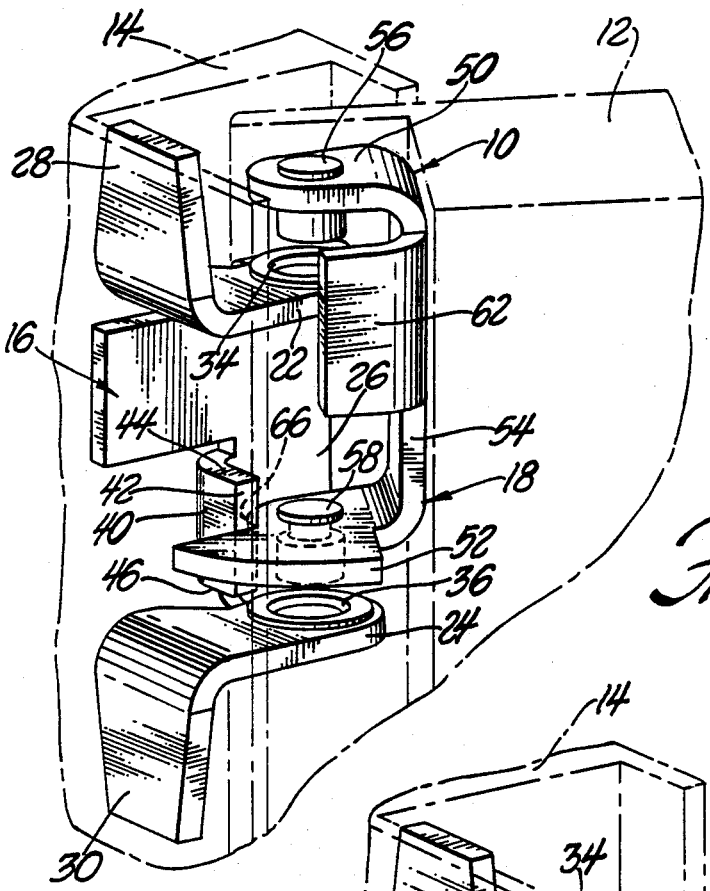
FIG. 3 is a view similar to FIG. 2 but showing the door having been lifted vertically to disengage the pivot pin from the pivot aperture.

Referring to FIG. 2, it is seen that the engagement of the pivot pins 56 and 58 within the bushings 34 and 36 causes the upper flange 50 and lower flange 52 of door hinge link 18 to rest upon the bushings 34 and 36, thereby determining the vertical height of the door and also establishing the pivot axis of the door. Accordingly, the door may be pivoted from the open position of FIG. 2 to the closed position of FIG. 1. As best seen in FIG. 1, it will be appreciated that the closed position of the door causes the door hinge leaf 18 and the body mounted hinge leaf 16 to become interleaved with one another so that the door cannot be moved upwardly with respect to the body. In particular, it is seen that the lower flange 52 of hinge leaf 18 enters the space between the lower flange 24 of leaf 16 and its flange 40. Also, the tab 62 of the hinge leaf 18 enters the space between the upper surface 44 of the tab 40 and the upper flange 22 of hinge leaf 16. Accordingly, as best seen in FIG. 1, the fully closed position of the door provides a load bearing column acting between the hinge leaves 16 and 18 by virtue of the interdigitating of the various elements including the upper flanges of the two hinge leaves, the tab 62, the tab 40, and the lower flanges of the hinge leaves. Accordingly, in the event of an application of an excessive load upon the body and door structure, the interdigitating load bearing construction strengthens the separable hinge.

Referring again to FIG. 2, it will be understood that a conventional door check mechanism such as a cable or a strap, not shown, is provided to act between the door 12 and the body 14 to limit the range of opening movement of the door to a degree somewhat less than the position shown in FIG. 2. Accordingly, a normal range of door movement between open and closed positions is defined in which the lower flange 52 of hinge leaf 18 remains captured between the lower flange 24 and the lower surface 46 of the flange 40 of hinge leaf 16. Thus, in order to remove the door from the vehicle, it is necessary to disconnect the door check in order to enable the outward pivoting movement of the door to the position of FIG. 2 or beyond in which the door may be lifted vertically upward to remove the door from the body.

Thus it is seen that the invention provides a new and improved separable door handle assembly for a vehicle body to be hung on the door and then later removed to facilitate vehicle assembly or service.

The embodiments of the invention in which an exclusive property or privilege is claimed are defined as follows:

1. A separable door hinge for removably hanging a door on a vehicle body comprising:

first and second hinge leaves mounted respectively upon the body and the door, one of said hinge leaves having a pivot pin mounted thereon and the other hinge leaf having a hinge aperture adapted to engage the pivot pin to establish a door hinge pivot axis, said first and second leaves having portions bearing upon one another through a range of door pivoting movement so that the engagement is maintained between the hinge aperture and the pivot pin, said door being separable from the body by pivoting the door beyond the range of door pivoting movement to disengage the bearing portions of the hinge leaves from one another and lifting the door axially of the hinge pivot axis to disengage the hinge aperture and the pivot pin, and means provided on the hinge leaves adapted to facilitate rehanging of the door on the body by providing an auxiliary pivot axis offset from and parallel with respect to the door hinge pivot axis operable during attempted rehanging of the door and serving to enable swinging movement of the door about the auxiliary pivot axis to carry the pivot pin and the pivot aperature into axial alignment with one another so that the door mounted hinge leaf may be lowered onto the body mounted hinge leaf to then enable pivoting movement of the door about the door hinge pivot axis to within the normal range of door pivoting movement.

2. The separable door hinge of claim 1 further characterized by each of said first and second hinge leaves having upper and lower flanges with a pivot pin and pivot aperture provided in each set of the upper and lower flanges, and in which each of the first and second hinge leaves have flanges carried thereon which interdigitate with one another at least when the door is fully closed to provide a load bearing column of interdigitated flanges extending between the upper flanges and the lower flanges.

3. A separable door hinge for removably hanging a door on a vehicle body comprising:

first and second hinge leaves mounted respectively upon the body and the door, one of said hinge leaves having a pivot pin mounted thereon and the other hinge leaf having a hinge aperture adapted to engage the pivot pin to establish a door hinge pivot axis, said first and second leaves having means interengaging one another through a range of door pivoting movement so that the engagement is maintained between the hinge aperture and the pivot pin, said door being separable from the body by pivoting the door beyond the range of door pivoting movement to disengage the bearing portions of the hinge leaves from one another and lifting the door axially of the hinge pivot axis to disengage the hinge aperture and the pivot pin, and means provided on the hinge leaves adapted to facilitate rehanging of the door on the body including an alignment abutment provided on one of the hinge leaves and extending parallel to the pivot axis and an alignment notch provided on the other of the hinge leaves, said abutment and said notch coming into engagement with one another during attempted rehanging of the door and serving to establish an auxiliary pivot axis enabling swinging movement of the door to establish the pivot pin and the pivot aperture in axial alignment with one another so that the door mounted hinge leaf may be lowered onto the body mounted hinge leaf to then enable pivoting movement of the door to within the normal range of door pivoting movement.

4. The separable door hinge of claim 3 in which said first and second hinge leaves are further characterized by being metal stampings and said interengaging means being provided by integral flanges bent from the hinge leaves and having an interdigitating relationship with one another when the door is hung on the body and pivoting within the normal range of movement.

5. The separable door hinge of claim 3 further characterized by each of said first and second hinge leaves having upper and lower flanges with a pivot pin and pivot aperture provided in each set of the upper and lower flanges.

6. The separable door hinge of claim 5 in which each of the first and second hinge leaves have flanges carried thereon which interdigitate with one another at least when the door is fully closed to provide a load bearing column of interdigitated flanges extending between the upper flange and the lower flange.

* * * * *